US009562439B2

(12) United States Patent
Iduate et al.

(10) Patent No.: US 9,562,439 B2
(45) Date of Patent: Feb. 7, 2017

(54) TURBINE NOZZLE AND METHOD FOR COOLING A TURBINE NOZZLE OF A GAS TURBINE ENGINE

(71) Applicant: General Electric Company, Schenectady, NY (US)

(72) Inventors: Michelle Jessica Iduate, Simpsonville, SC (US); Gregory Thomas Foster, Greer, SC (US); David Wayne Weber, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 461 days.

(21) Appl. No.: 14/141,789

(22) Filed: Dec. 27, 2013

(65) Prior Publication Data

US 2015/0184530 A1 Jul. 2, 2015

(51) Int. Cl.

| | |
|---|---|
| ***F01D 9/06*** | (2006.01) |
| ***F01D 9/04*** | (2006.01) |
| ***F01D 9/02*** | (2006.01) |
| *F01D 5/18* | (2006.01) |

(52) U.S. Cl.

CPC ..... *F01D 9/065* (2013.01); *F01D 9/041* (2013.01); *F01D 5/186* (2013.01); *F01D 9/02* (2013.01); *F05D 2240/81* (2013.01); *F05D 2250/185* (2013.01); *F05D 2260/202* (2013.01)

(58) Field of Classification Search

CPC ..... F05D 2240/80; F05D 2240/81; F05D 2240/10–2240/129; F05D 5/18; F05D 5/085; F05D 5/087; F05D 5/186; F05D 9/02; F05D 9/04; F05D 9/041; F05D 9/047; F05D 9/06; F05D 9/065

USPC ..... 415/115, 116; 416/96 R, 97 R, 193 A

See application file for complete search history.

(56) References Cited

U.S. PATENT DOCUMENTS

| | | | | |
|---|---|---|---|---|
| 3,849,025 | A * | 11/1974 | Grondahl | F01D 5/185 416/96 R |
| 4,353,679 | A * | 10/1982 | Hauser | F01D 5/189 165/47 |
| 5,997,245 | A * | 12/1999 | Tomita | F01D 5/187 415/115 |
| 6,270,317 | B1 | 8/2001 | Manning et al. | |
| 6,769,865 | B2 | 8/2004 | Kress et al. | |
| 6,783,323 | B2 * | 8/2004 | Shiozaki | F01D 5/18 415/115 |
| 6,929,445 | B2 | 8/2005 | Zatorski et al. | |
| 6,955,523 | B2 | 10/2005 | McClelland | |

(Continued)

*Primary Examiner* — Gerald L Sung
*Assistant Examiner* — Alain Chau
(74) *Attorney, Agent, or Firm* — Sutherland Asbill & Brennan LLP

(57) ABSTRACT

The present application and the resultant patent provide a turbine nozzle for a gas turbine engine. The turbine nozzle may include a first nozzle vane, a second nozzle vane, and a platform connecting the first nozzle vane and the second nozzle vane. The platform may include a first cooling passage and a separate second cooling passage defined therein. The first cooling passage may be configured to direct a first flow of cooling fluid in a first direction, and the second cooling passage may be configured to direct a second flow of cooling fluid in a second direction substantially opposite the first direction. The present application and the resultant patent further provide a method for cooling a turbine nozzle of a gas turbine engine.

18 Claims, 6 Drawing Sheets

(56) References Cited

U.S. PATENT DOCUMENTS

| | | | | |
|---|---|---|---|---|
| 7,416,391 | B2 * | 8/2008 | Veltre | F01D 5/187 416/193 A |
| 8,096,772 | B2 | 1/2012 | Liang | |
| 8,353,669 | B2 | 1/2013 | Chon et al. | |
| 8,632,298 | B1 * | 1/2014 | Liang | F01D 9/041 415/115 |
| 2007/0253816 | A1 * | 11/2007 | Walz | F01D 5/186 416/97 R |
| 2011/0243711 | A1 | 10/2011 | Vehr | |
| 2012/0177479 | A1 * | 7/2012 | Azad | F01D 5/187 415/115 |
| 2013/0175357 | A1 | 7/2013 | Winn et al. | |
| 2013/0177384 | A1 | 7/2013 | Coign et al. | |
| 2013/0177396 | A1 | 7/2013 | Winn | |
| 2013/0177420 | A1 | 7/2013 | Winn et al. | |
| 2013/0177447 | A1 | 7/2013 | Coign et al. | |
| 2013/0209231 | A1 * | 8/2013 | Davis | F01D 9/041 415/115 |

* cited by examiner

TURBINE NOZZLE AND METHOD FOR COOLING A TURBINE NOZZLE OF A GAS TURBINE ENGINE

TECHNICAL FIELD

The present application and the resultant patent relate generally to gas turbine engines and more particularly relate to a turbine nozzle and a method for cooling a turbine nozzle of a gas turbine engine at high operating temperatures.

BACKGROUND OF THE INVENTION

In a gas turbine engine, hot combustion gases generally flow from one or more combustors through a transition piece and along a hot gas path. A number of turbine stages typically may be disposed in series along the hot gas path so that the combustion gases flow through first-stage nozzles and buckets and subsequently through nozzles and buckets of later stages of the turbine. In this manner, the nozzles may direct the combustion gases toward the respective buckets, causing the buckets to rotate and drive a load, such as an electrical generator and the like. The combustion gases may be contained by circumferential shrouds surrounding the buckets, which also may aid in directing the combustion gases along the hot gas path. In this manner, the turbine nozzles, buckets, and shrouds may be subjected to high temperatures resulting from the combustion gases flowing along the hot gas path, which may result in the formation of hot spots and high thermal stresses in these components. Because the efficiency of a gas turbine engine is dependent on its operating temperatures, there is an ongoing demand for components positioned within and along the hot gas path, such as turbine nozzles, buckets, and shrouds, to be capable of withstanding increasingly higher temperatures without deterioration, failure, or decrease in useful life.

Certain turbine nozzles, particularly those of middle and later turbine stages, may include a one or more passages or cavities defined within the nozzles for cooling purposes. For example, cooling passages may be defined within the inner platform, the outer platform, and/or the vane of a turbine nozzle, depending on the specific cooling needs of the nozzle, as may vary from stage to stage of the turbine. According to certain configurations, the cooling passages may be defined near a hot gas path surface of the turbine nozzle. In this manner, the cooling passages may transport a cooling fluid, such as compressor bleed air, through the turbine nozzle for exchanging heat in order to maintain the temperature of the region near the hot gas path surface within an acceptable range. Based on a desire to maximize the region of cooling coverage, the cooling passages may be long and may have a complex shape, such as a winding or serpentine shape, including a number of turns or bends. Long cooling passages having a complex shape, however, may be challenging and costly to manufacture, and also may result in an undesirable pressure drop along the cooling passages. Moreover, the heat transfer performance of such cooling passages may vary significantly, and thus optimizing the cooling passages for the applicable turbine stage may be particularly challenging.

There is thus a desire for an improved turbine nozzle including a cooling passage configuration for cooling the turbine nozzle at high operating temperatures. Specifically, such a cooling passage configuration should maximize the region of cooling coverage while minimizing the length and complexity of the cooling passages. In this manner, such a cooling passage configuration should minimize the cost and complexity of manufacturing the turbine nozzle, and also should minimize the pressure drop along the cooling passages. Moreover, such a cooling passage configuration should minimize variation of the heat transfer performance of the cooling passages, and thus should ease optimization of the cooling passages for the applicable turbine stage.

SUMMARY OF THE INVENTION

The present application and the resultant patent thus provide a turbine nozzle for a gas turbine engine. The turbine nozzle may include a first nozzle vane, a second nozzle vane, and a platform connecting the first nozzle vane and the second nozzle vane. The platform may include a first cooling passage and a separate second cooling passage defined therein. The first cooling passage may be configured to direct a first flow of cooling fluid in a first direction, and the second cooling passage may be configured to direct a second flow of cooling fluid in a second direction substantially opposite the first direction.

The present application and the resultant patent further provide a method for cooling a turbine nozzle of a gas turbine engine. The method may include the step of providing a turbine nozzle including a first nozzle vane, a second nozzle vane, and a platform connecting the first nozzle vane and the second nozzle vane, the platform including a first cooling passage and a separate second cooling passage defined therein. The method also may include the step of passing a first flow of cooling fluid through the first cooling passage in a first direction. The method further may include the step of passing a second flow of cooling fluid through the second cooling passage in a second direction substantially opposite the first direction.

The present application and the resultant patent further provide a gas turbine engine. The gas turbine engine may include a compressor, a combustor in communication with the compressor, and a turbine in communication with the combustor. The turbine may include a number of turbine nozzles arranged in a circumferential array. Each of the turbine nozzles may include a first nozzle vane, a second nozzle vane, and a platform connecting the first nozzle vane and the second nozzle vane. The platform may include a first cooling passage and a separate second cooling passage defined therein. The first cooling passage may be configured to direct a first flow of cooling fluid in a first direction, and the second cooling passage may be configured to direct a second flow of cooling fluid in a second direction substantially opposite the first direction.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
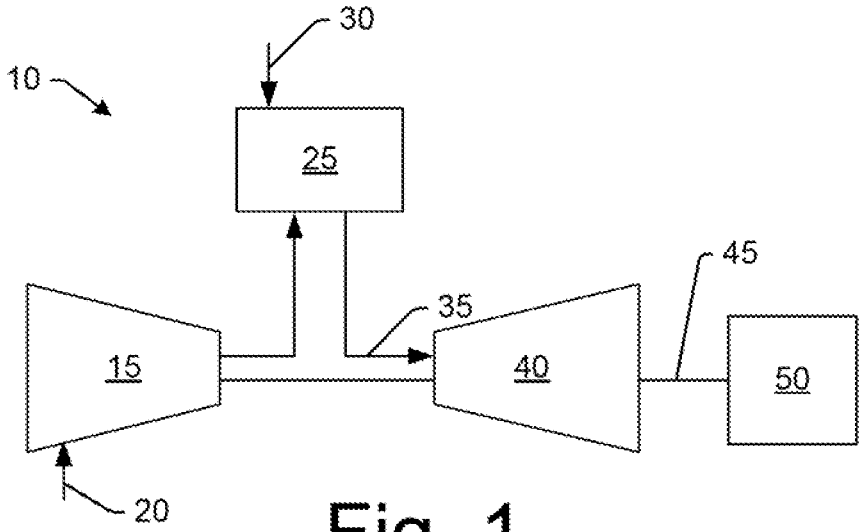
FIG. 1 is a schematic diagram of a gas turbine engine including a compressor, a combustor, and a turbine.

Referring now to the drawings, in which like numerals refer to like elements throughout the several views, FIG. 1 shows a schematic diagram of a gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like. Other configurations and other components may be used herein.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together. Although the gas turbine engine 10 is shown herein, the present application may be applicable to any type of turbo machinery.

Figure 2:
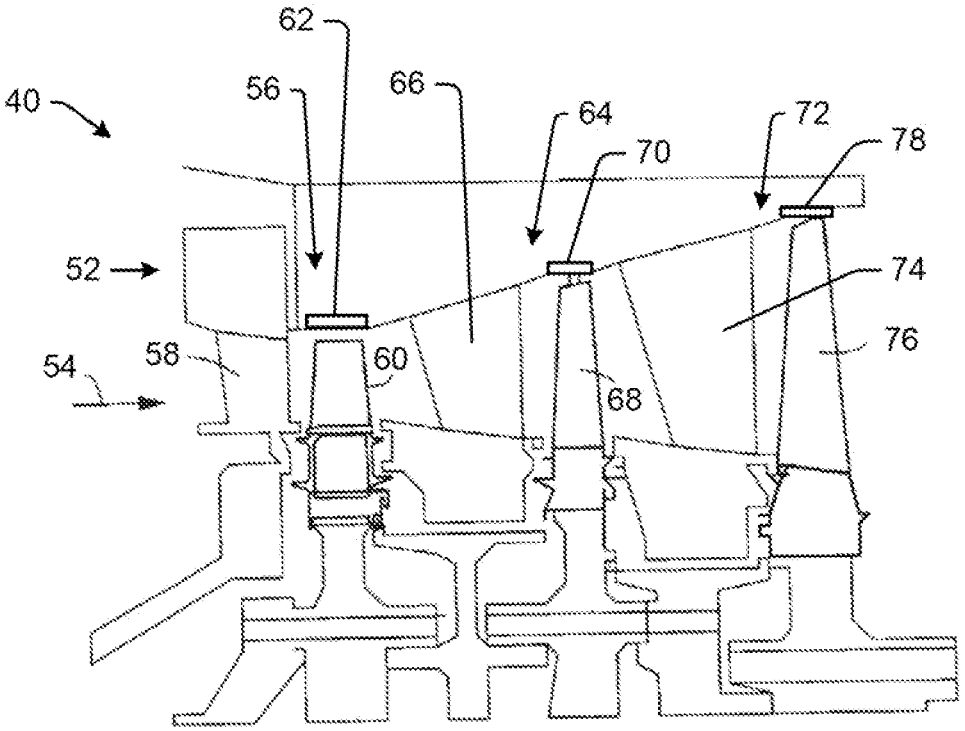
FIG. 2 is a schematic diagram of a portion of a turbine as may be used in the gas turbine engine of FIG. 1, showing a number of turbine stages.

FIG. 2 shows a schematic diagram of a portion of the turbine 40 including a number of stages 52 positioned in a hot gas path 54 of the gas turbine engine 10. A first stage 56 may include a number of circumferentially-spaced first-stage nozzles 58 and a number of circumferentially-spaced first-stage buckets 60. The first stage 56 also may include a first-stage shroud 62 extending circumferentially and surrounding the first-stage buckets 60. The first-stage shroud 62 may include a number of shroud segments positioned adjacent one another in an annular arrangement. In a similar manner, a second stage 64 may include a number of second-stage nozzles 66, a number of second-stage buckets 68, and a second-stage shroud 70 surrounding the second-stage buckets 68. Further, a third stage 72 may include a number of third-stage nozzles 74, a number of third-stage buckets 76, and a third-stage shroud 78 surrounding the third-stage buckets 76. Although the portion of the turbine 40 is shown as including three stages 52, the turbine 40 may include any number of stages 52.

Figure 3:
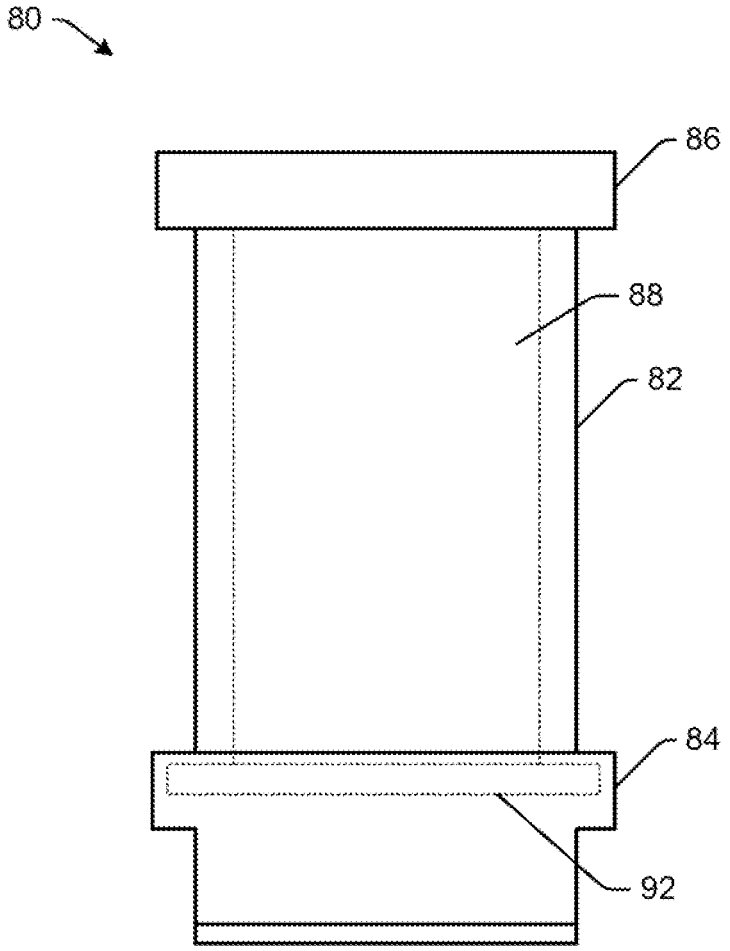
FIG. 3 is a schematic diagram of a turbine nozzle as may be used in the turbine of FIG. 2.

FIG. 3 shows a schematic diagram of a turbine nozzle 80 as may be used in one of the stages 52 of the turbine 40. Generally described, the nozzle 80 may include a nozzle vane 82 extending between an inner platform 84 and an outer platform 86. In some embodiments, the nozzle 80 may include two or more nozzle vanes 82 extending between the inner platform 84 and the outer platform 86. As described above, a number of the nozzles 80 may be arranged in a circumferential array within the stage 52 of the turbine 40. In this manner, the nozzle vanes 82 may extend radially with respect to a central axis of the turbine 40, while the inner platforms 84 and the outer platforms 86 extend circumferentially with respect to the central axis of the turbine 40. The inner platforms 84 of adjacent nozzles 80 may abut one another and may form a radially inner boundary of the hot gas path 54. The outer platforms 86 of adjacent nozzles 80 similarly may abut one another and may form a radially outer boundary of the hot gas path 54.

As is shown, the turbine nozzle 80 may include at least one cooling cavity 88 defined within the nozzle vane 82 and in communication with a cooling source. The turbine nozzle 80 also may include a cooling plenum 92 defined within the inner platform 84 and in communication with the cooling cavity 88. During operation of the turbine 40, a flow of cooling fluid, such as a flow of discharge or extraction air from the compressor 15, may pass into the cooling cavity 88 and then into the cooling plenum 92 so as to cool desired portions of the turbine nozzle 80. Other components and other configurations may be used herein.

Figure 4:
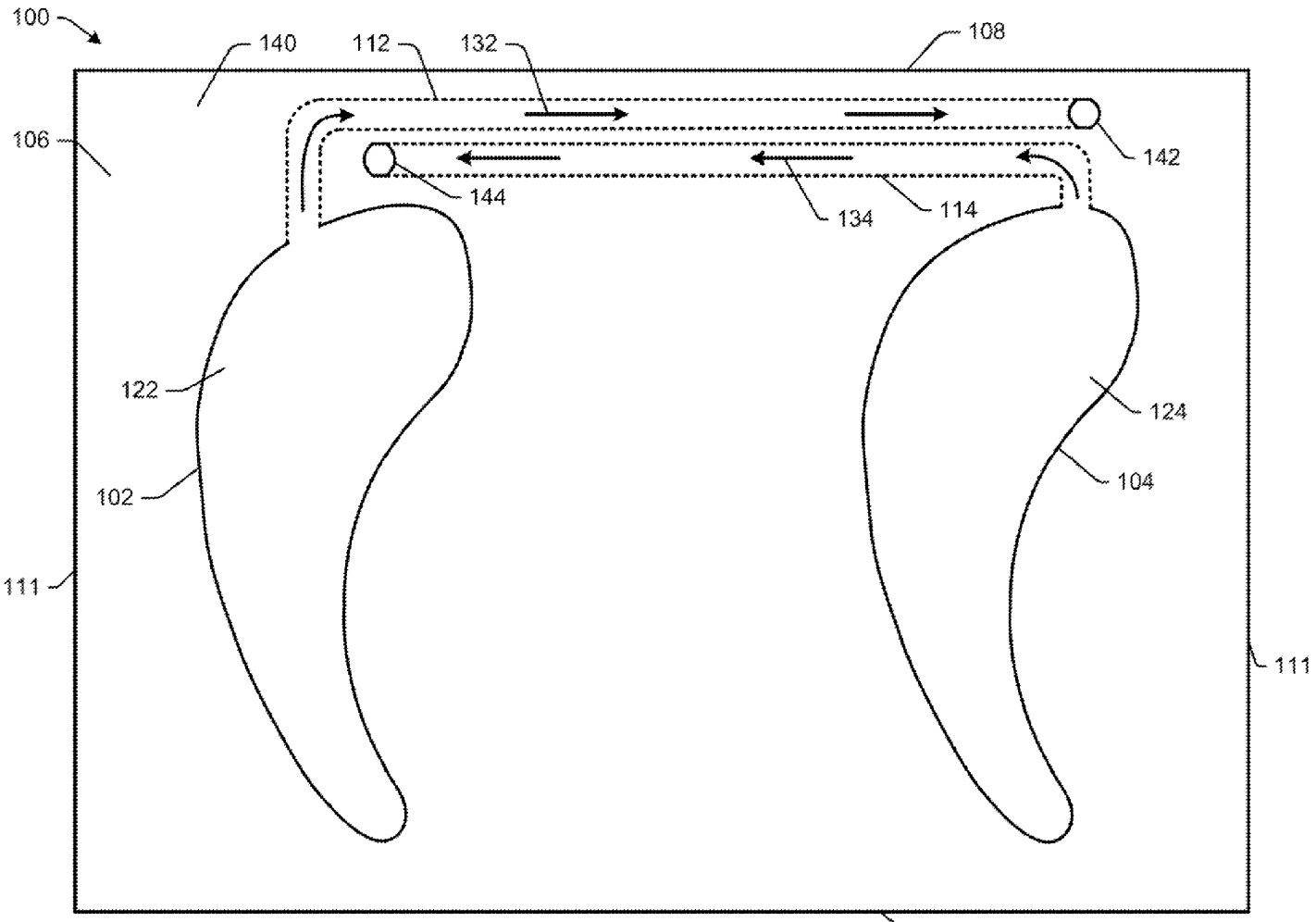
FIG. 4 is a schematic diagram of an embodiment of a turbine nozzle as may be described herein and as may be used in the turbine of FIG. 2, showing cooling passages illustrated by hidden lines.

FIG. 4 shows a schematic diagram of an embodiment of a turbine nozzle 100 as may be described herein. The turbine nozzle 100 may be used in one of the stages 52 of the turbine 40 and generally may be configured and arranged in a manner similar to the turbine nozzle 80 described above, although certain differences in structure and function are described herein below. The turbine nozzle 100 may include a first nozzle vane 102 and a second nozzle vane 104 each extending between an inner platform 106 and an outer platform (not shown). In this manner, the inner platform 106 may connect the first nozzle vane 102 and the second nozzle vane 104, and the outer platform also may connect the first nozzle vane 102 and the second nozzle vane 104. As is shown, the inner platform 106 may include a leading edge 108, a trailing edge 110, and lateral edges 111. The outer platform may be configured in a similar manner.

The turbine nozzle 100 may include a first cooling passage 112 and a separate second cooling passage 114 defined within the inner platform 106. In this manner, the first cooling passage 112 and the second cooling passage 114 may be independent of one another such that the first cooling passage 112 is not in fluid communication with the second cooling passage 114. As is shown, the first cooling passage 112 may be in fluid communication with a first cooling cavity 122 defined within the first nozzle vane 102, and the second cooling passage 114 may be in fluid communication with a second cooling cavity 124 defined within the second nozzle vane 104. In this manner, the first cooling passage 112 may be configured to receive a cooling fluid from the first cooling cavity 122, and the second cooling passage 114 similarly may be configured to receive a cooling fluid from the second cooling cavity 124. In some embodiments, multiple first cooling cavities 122 may be defined within the first nozzle vane 102, and multiple second cooling cavities 124 may be defined within the second nozzle vane 104. Although the first cooling passage 112 and the second cooling passage 114 may be described herein as being defined within the inner platform 106, the cooling passages 112, 114 alternatively may be defined in a similar manner within the outer platform of the turbine nozzle 100.

During operation of the turbine 40, a cooling fluid, such as discharge or extraction air from the compressor 15, may be directed into each of the first cooling cavity 122 and the second cooling cavity 124 of the turbine nozzle 100. At least a portion of the cooling fluid directed into the first cooling cavity 122 may pass into and through the first cooling passage 112, thereby forming a first flow of cooling fluid 132. At least a portion of the cooling fluid directed into the second cooling cavity 124 similarly may pass into and through the second cooling passage 114, thereby forming a second flow of cooling fluid 134. In this manner, the first flow of cooling fluid 132 and the second flow of cooling fluid 134 may exchange heat with regions of the inner platform 106 surrounding the first cooling passage 112 and the second cooling passage 114 in order to maintain the temperature of the regions within an acceptable range.

As is shown in FIG. 4, the first cooling passage 112 may be configured to direct the first flow of cooling fluid 132 in a first direction for at least a portion of the first cooling passage 112. For example, the first cooling passage 112 may be configured to direct the first flow of cooling fluid 132 in the first direction toward the second nozzle vane 104 for at least a portion of the first cooling passage 112. The second cooling passage 114 may be configured to direct the second flow of cooling fluid 134 in a second direction, substantially opposite the first direction, for at least a portion of the second cooling passage 114. For example, the second cooling passage 114 may be configured to direct the second flow of cooling fluid 134 in the second direction toward the first nozzle vane 102 for at least a portion of the second cooling passage 114.

In some embodiments, the first cooling passage 112 and the second cooling passage 114 may be positioned near a hot gas path surface of the inner platform 106. For example, the first cooling passage 112 and the second cooling passage 114 may be positioned near a radially outer surface 140 of the inner platform 106. Further, in some embodiments, the first cooling passage 112 and the second cooling passage 114 may be positioned near the leading edge 108 of the inner platform 106, as is shown. According to the embodiment of FIG. 4, the first cooling passage 112 may extend upstream of the second cooling passage 114, although this configuration may be reversed in other embodiments. In some embodiments, the first cooling passage 112 and the second cooling passage 114 may at least partially overlap one another in a radial manner with respect to the central axis of the turbine 40.

The first cooling passage 112 and the second cooling passage 114 may be configured to exhaust the first flow of cooling fluid 132 and the second flow of cooling fluid 134, respectively, via one or more exhaust apertures 142, 144. As is shown, the exhaust apertures 142, 144 may be defined in the radially outer surface 140 of the inner platform 106, such that the flows of cooling fluid 132, 134 may be used for film cooling the radially outer surface 140. In some embodiments, the exhaust apertures 142, 144 may be defined along the leading edge 108, the trailing edge 110, or the lateral edges 111 of the inner platform 106, such that the flows of cooling fluid 132, 134 may be purged thereabout.

Figure 5:
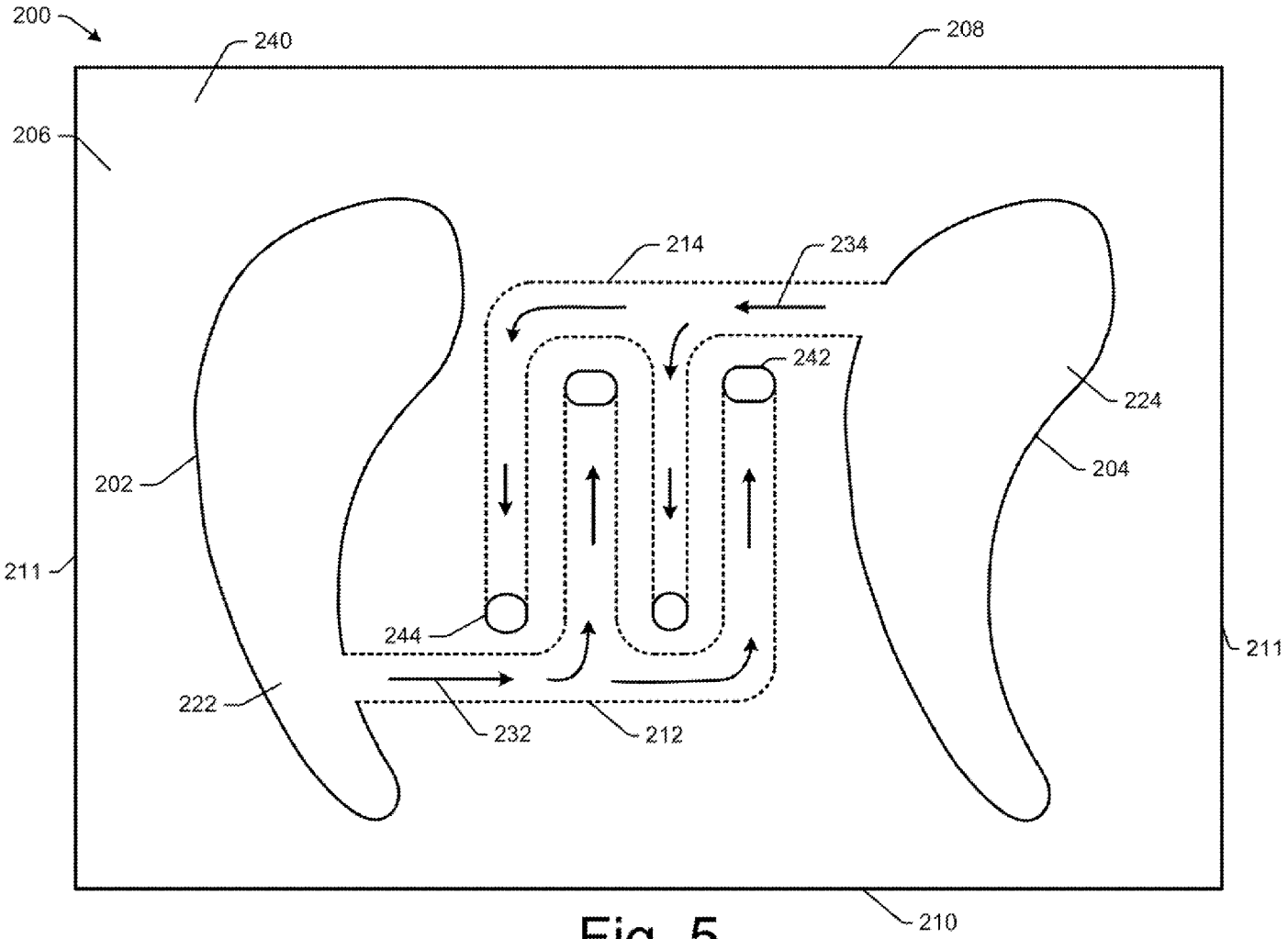
FIG. 5 is a schematic diagram of another embodiment of a turbine nozzle as may be described herein and as may be used in the turbine of FIG. 2, showing cooling passages illustrated by hidden lines.

FIG. 5 shows a schematic diagram of another embodiment of a turbine nozzle 200 as may be described herein. The turbine nozzle 200 includes various features corresponding to those described above with respect to the turbine nozzle 100, which features are identified in FIG. 5 with corresponding numerals and are not described in further detail herein below. The turbine nozzle 200 may be used in one of the stages 52 of the turbine 40, and may include a first nozzle vane 202, a second nozzle vane 204, and an inner platform 206 including a leading edge 208, a trailing edge 210, and lateral edges 211. The inner platform 206 may include a first cooling passage 212 in fluid communication with a first cooling cavity 222, and a separate second cooling passage 214 in fluid communication with a second cooling cavity 224. In some embodiments, multiple first cooling cavities 222 may be defined within the first nozzle vane 202, and multiple second cooling cavities 224 may be defined within the second nozzle vane 204.

As is shown in FIG. 5, the first cooling passage 212 may be configured to direct a first flow of cooling fluid 232 in a first direction for at least a portion of the first cooling passage 212. For example, the first cooling passage 212 may be configured to direct the first flow of cooling fluid 232 in the first direction toward the second nozzle vane 204 for at least a portion of the first cooling passage 212. Further, the first cooling passage 212 may be configured to direct the first flow of cooling fluid 232 in the first direction toward the leading edge 208 of the inner platform 206 for at least a portion of the first cooling passage 212. The second cooling passage 214 may be configured to direct a second flow of cooling fluid 234 in a second direction, substantially opposite the first direction, for at least a portion of the second cooling passage 214. For example, the second cooling passage 214 may be configured to direct the second flow of cooling fluid 234 in the second direction toward the first nozzle vane 202 for at least a portion of the second cooling passage 214. Further, the second cooling passage 214 may be configured to direct the second flow of cooling fluid 234 in the second direction toward the trailing edge 210 of the inner platform 206 for at least a portion of the second cooling passage 214.

In some embodiments, the cooling passages 212, 214 may be positioned near a hot gas path surface of the inner platform 206, such as a radially outer surface 240 of the inner platform 206. Further, in some embodiments, at least a portion of the cooling passages 212, 214 may be positioned near the leading edge 208 of the inner platform 206. In some embodiments, the second cooling passage 214 may extend upstream of the first cooling passage 212, although this configuration may be reversed in other embodiments. According to the embodiment of FIG. 5, the first cooling passage 212 and the second cooling passage 214 may at least partially mesh with one another. For example, portions of the first cooling passage 212 may interdigitate with corresponding portions of the second cooling passage 214, as is shown.

The first cooling passage 212 and the second cooling passage 214 may be configured to exhaust the first flow of cooling fluid 232 and the second flow of cooling fluid 234, respectively, via one or more exhaust apertures 242, 244. As is shown, the exhaust apertures 242, 244 may be defined in the radially outer surface 240 of the inner platform 206, such that the flows of cooling fluid 232, 234 may be used for film cooling the radially outer surface 240. In some embodiments, the exhaust apertures 242, 244 may be defined along the leading edge 208, the trailing edge 210, or the lateral edges 211 of the inner platform 206, such that the flows of cooling fluid 232, 234 may be purged thereabout.

Figure 6:
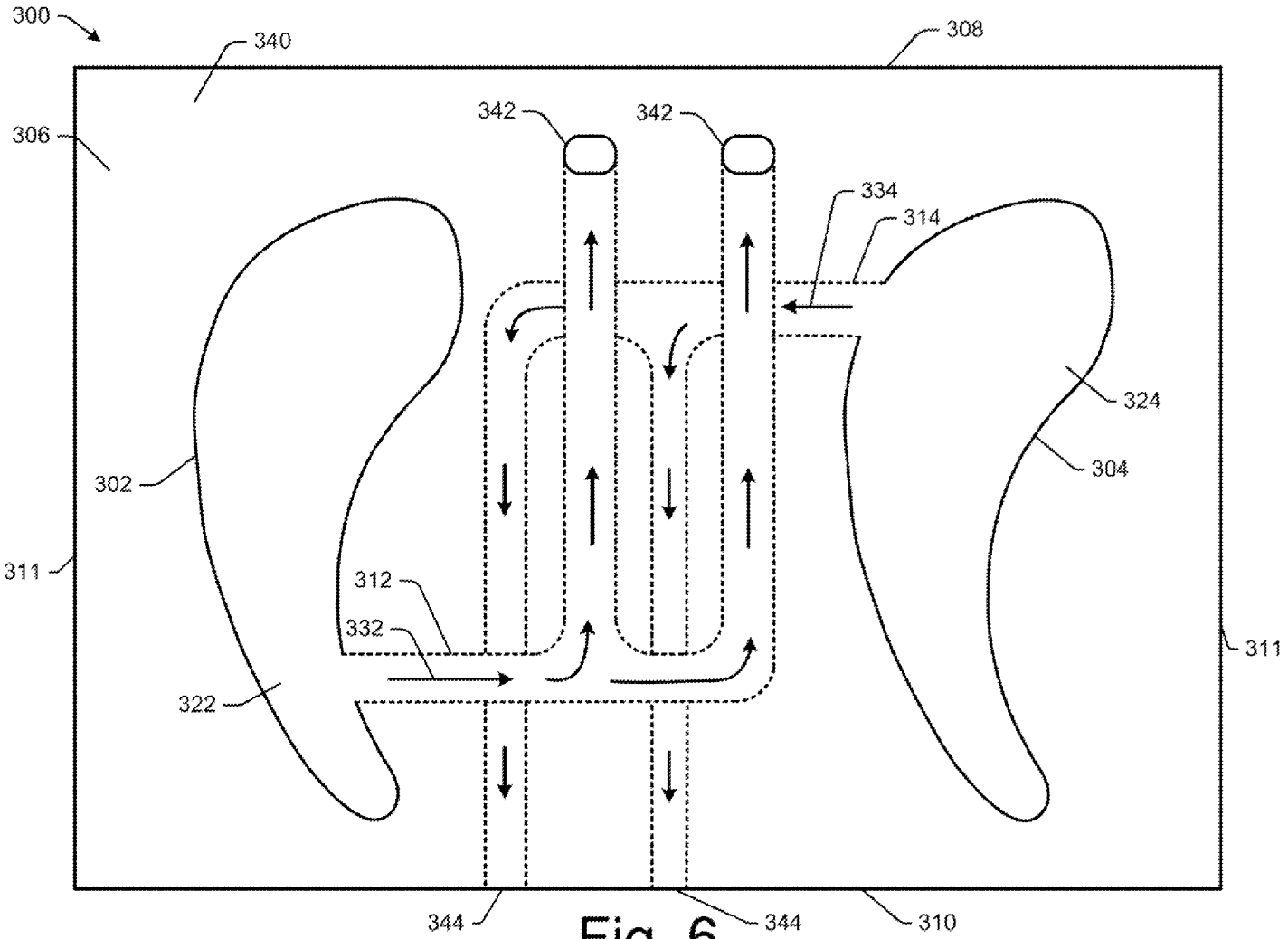
FIG. 6 is a schematic diagram of another embodiment of a turbine nozzle as may be described herein and as may be used in the turbine of FIG. 2, showing cooling passages illustrated by hidden lines.

FIG. 6 shows a schematic diagram of another embodiment of a turbine nozzle 300 as may be described herein. The turbine nozzle 300 includes various features corresponding to those described above with respect to the turbine nozzle 100, which features are identified in FIG. 6 with corresponding numerals and are not described in further detail herein below. The turbine nozzle 300 may be used in one of the stages 52 of the turbine 40, and may include a first nozzle vane 302, a second nozzle vane 304, and an inner platform 306 including a leading edge 308, a trailing edge 310, and lateral edges 311. The inner platform 306 may include a first cooling passage 312 in fluid communication with a first cooling cavity 322, and a separate second cooling passage 314 in fluid communication with a second cooling cavity 324. In some embodiments, multiple first cooling cavities 322 may be defined within the first nozzle vane 302, and multiple second cooling cavities 324 may be defined within the second nozzle vane 304.

As is shown in FIG. 6, the first cooling passage 312 may be configured to direct a first flow of cooling fluid 332 in a first direction for at least a portion of the first cooling passage 312. For example, the first cooling passage 312 may be configured to direct the first flow of cooling fluid 332 in the first direction toward the second nozzle vane 304 for at least a portion of the first cooling passage 312. Further, the first cooling passage 312 may be configured to direct the first flow of cooling fluid 332 in the first direction toward the leading edge 308 of the inner platform 306 for at least a portion of the first cooling passage 312. The second cooling passage 314 may be configured to direct a second flow of cooling fluid 334 in a second direction, substantially opposite the first direction, for at least a portion of the second cooling passage 314. For example, the second cooling passage 314 may be configured to direct the second flow of cooling fluid 334 in the second direction toward the first nozzle vane 302 for at least a portion of the second cooling passage 314. Further, the second cooling passage 314 may be configured to direct the second flow of cooling fluid 334 in the second direction toward the trailing edge 310 of the inner platform 306 for at least a portion of the second cooling passage 314.

In some embodiments, the cooling passages 312, 314 may be positioned near a hot gas path surface of the inner platform 306, such as a radially outer surface 340 of the inner platform 306. Further, in some embodiments, at least a portion of the cooling passages 312, 314 may be positioned near the leading edge 308 of the inner platform 306. In some embodiments, the first cooling passage 312 may extend upstream of the second cooling passage 314, although this configuration may be reversed in other embodiments. According to the embodiment of FIG. 6, the first cooling passage 312 and the second cooling passage 314 may at least partially overlap one another in a radial manner with respect to the central axis of the turbine 40. For example, at least portions of the first cooling passage 312 may be positioned radially outward with respect to portions of the second cooling passage 314, as is shown.

The first cooling passage 312 and the second cooling passage 314 may be configured to exhaust the first flow of cooling fluid 332 and the second flow of cooling fluid 334, respectively, via one or more exhaust apertures 342, 344. As is shown, the exhaust apertures 342 may be defined in the radially outer surface 340 of the inner platform 306, such that the first flow of cooling fluid 332 may be used for film cooling the radially outer surface 340. In some embodiments, the exhaust apertures 342 may be positioned near the leading edge 308 of the inner platform 306. In some embodiments, the exhaust apertures 344 may be defined along the leading edge 308, the trailing edge 310, or the lateral edges 311 of the inner platform 306, such that the second flow of cooling fluid 334 may be purged thereabout.

Figure 7:
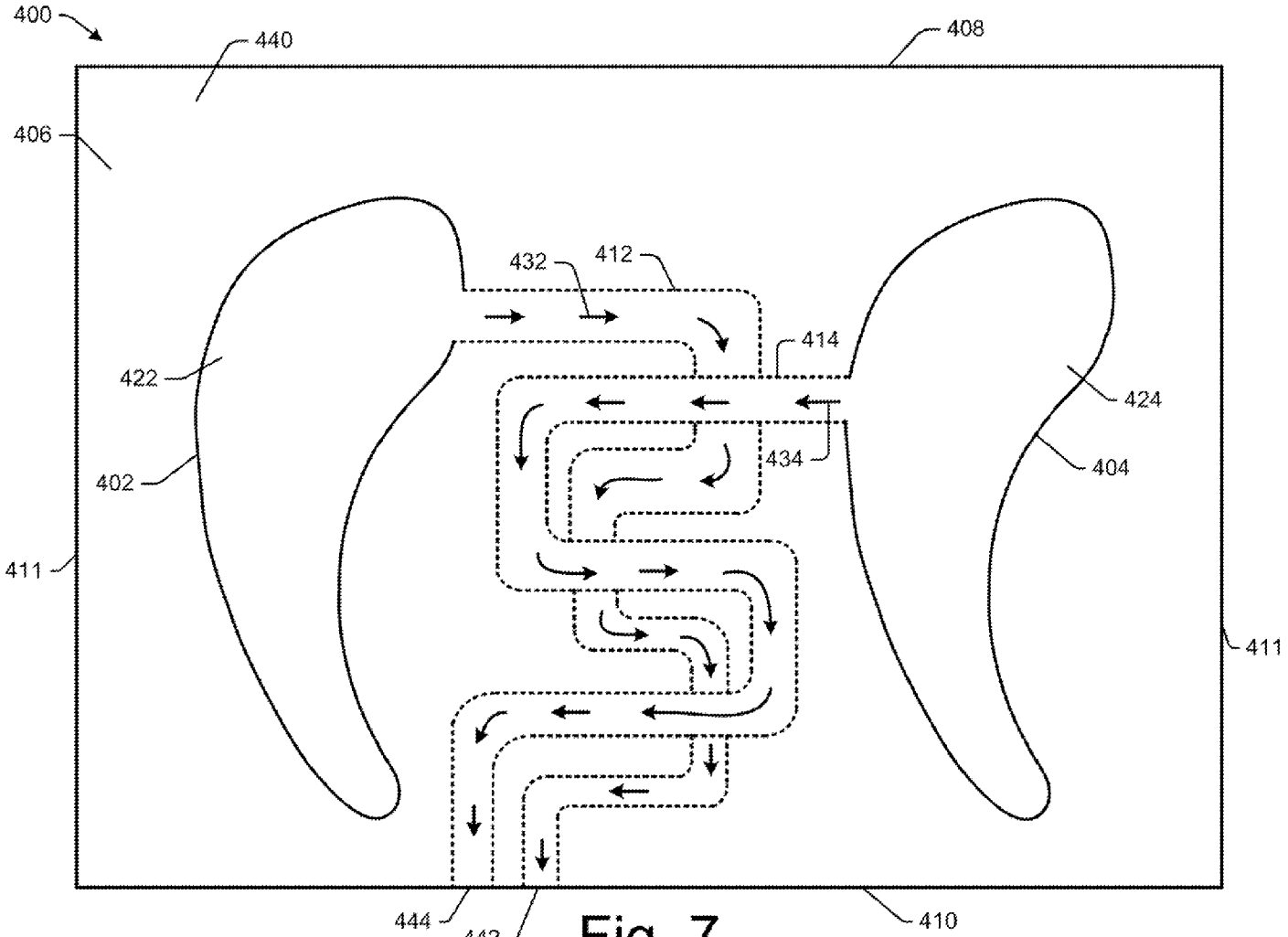
FIG. 7 is a schematic diagram of another embodiment of a turbine nozzle as may be described herein and as may be used in the turbine of FIG. 2, showing cooling passages illustrated by hidden lines.

FIG. 7 shows a schematic diagram of another embodiment of a turbine nozzle 400 as may be described herein. The turbine nozzle 400 includes various features corresponding to those described above with respect to the turbine nozzle 100, which features are identified in FIG. 7 with corresponding numerals and are not described in further detail herein below. The turbine nozzle 400 may be used in one of the stages 52 of the turbine 40, and may include a first nozzle vane 402, a second nozzle vane 404, and an inner platform 406 including a leading edge 408, a trailing edge 410, and lateral edges 411. The inner platform 406 may include a first cooling passage 412 in fluid communication with a first cooling cavity 422, and a separate second cooling passage 414 in fluid communication with a second cooling cavity 424. In some embodiments, multiple first cooling cavities 422 may be defined within the first nozzle vane 402, and multiple second cooling cavities 424 may be defined within the second nozzle vane 404.

As is shown in FIG. 7, the first cooling passage 412 may be configured to direct a first flow of cooling fluid 432 in a first direction for at least a portion of the first cooling passage 412. For example, the first cooling passage 412 may be configured to direct the first flow of cooling fluid 432 in the first direction toward the second nozzle vane 404 for at least a portion of the first cooling passage 412. Further, the first cooling passage 412 may be configured to direct the first flow of cooling fluid 432 in the first direction toward the first nozzle vane 402 for at least a portion of the first cooling passage 412. The second cooling passage 414 may be configured to direct a second flow of cooling fluid 434 in a second direction, substantially opposite the first direction, for at least a portion of the second cooling passage 414. For example, the second cooling passage 414 may be configured to direct the second flow of cooling fluid 434 in the second direction toward the first nozzle vane 402 for at least a portion of the second cooling passage 414. Further, the second cooling passage 414 may be configured to direct the second flow of cooling fluid 434 in the second direction toward the second nozzle vane 404 for at least a portion of the second cooling passage 414.

In some embodiments, the cooling passages 412, 414 may be positioned near a hot gas path surface of the inner platform 406, such as a radially outer surface 440 of the inner platform 406. Further, in some embodiments, at least a portion of the cooling passages 412, 414 may be positioned near the leading edge 408 of the inner platform 406. In some embodiments, the first cooling passage 412 may extend upstream of the second cooling passage 414, although this configuration may be reversed in other embodiments. According to the embodiment of FIG. 7, the first cooling passage 412 and the second cooling passage 414 may at least partially overlap one another in a radial manner with respect to the central axis of the turbine 40. For example, at least portions of the second cooling passage 414 may be positioned radially outward with respect to portions of the second cooling passage 414, as is shown. Further, according to the embodiment of FIG. 7, the first cooling passage 412 and the second cooling passage 414 may be at least partially intertwined with one another. For example, the first cooling passage 412 and the second cooling passage 414 each may have a serpentine shape, and the sinusoidal curvature of the cooling passages 412, 414 may be offset such that portions of the first cooling passage 412 may be positioned between corresponding portions of the second cooling passage 414, as is shown.

The first cooling passage 412 and the second cooling passage 414 may be configured to exhaust the first flow of cooling fluid 432 and the second flow of cooling fluid 434, respectively, via one or more exhaust apertures 442, 444. In some embodiments, the exhaust apertures 442, 444 may be defined along the leading edge 408, the trailing edge 410, or the lateral edges 411 of the inner platform 406, such that the flows of cooling fluid 432, 434 may be purged thereabout. In other embodiments, the exhaust apertures 442, 444 may be defined in the radially outer surface 440 of the inner platform 406, such that the flows of cooling fluid 432, 434 may be used for film cooling the radially outer surface 440.

The embodiments described herein thus provide an improved turbine nozzle including a cooling passage configuration for cooling the turbine nozzle at high operating temperatures. As described above, the turbine nozzle may include a first cooling passage and a separate second cooling passage defined within a platform connecting a first nozzle vane and a second nozzle vane. The first cooling passage may be configured to direct a first flow of cooling fluid in a first direction, and the second cooling passage may be configured to direct a second flow of cooling fluid in a second direction opposite the first direction. Therefore, the cooling passages may provide a counter-flowing configuration of the flows of cooling fluid, which may maximize the region of cooling coverage while minimizing the length and complexity of each of the cooling passages. In this manner, the cooling passage configuration may minimize the cost and complexity of manufacturing the turbine nozzle, and also may minimize the pressure drop along the cooling passages. Moreover, the cooling passage configuration may minimize variation of the heat transfer performance of the cooling passages, and thus should ease optimization of the cooling passages for the applicable turbine stage. Ultimately, the cooling passage configuration may allow the turbine nozzle to withstand high operating temperatures without deterioration, failure, or decrease in useful life, and may enhance efficiency of the turbine and overall gas turbine engine.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A turbine nozzle for a gas turbine engine, the turbine nozzle comprising:

a first nozzle vane;

a second nozzle vane; and a platform connecting the first nozzle vane and the second nozzle vane, the platform comprising a first cooling passage and a separate second cooling passage defined therein such that the first cooling passage and the second cooling passage are not in fluid communication with one another;

wherein the first cooling passage is in fluid communication with a first cooling cavity defined within the first nozzle vane;

wherein the second cooling passage is in fluid communication with a second cooling cavity defined within the second nozzle vane;

wherein the first cooling passage and the second cooling passage at least partially overlap one another in an axial direction or a radial direction;

wherein the first cooling passage is configured to direct a first flow of cooling fluid in a first direction; and wherein the second cooling passage is configured to direct a second flow of cooling fluid in a second direction substantially opposite the first direction.

2. The turbine nozzle of claim 1, wherein the first cooling passage and the second cooling passage at least partially mesh with one another such that a portion of one of the first cooling passage and the second cooling passage is positioned between portions of the other of the first cooling passage and the second cooling passage in a circumferential direction.

3. The turbine nozzle of claim 1, wherein the first cooling passage and the second cooling passage at least partially overlap one another in the radial direction.

4. The turbine nozzle of claim 1, wherein the first cooling passage and the second cooling passage are at least partially intertwined with one another.

5. The turbine nozzle of claim 1, wherein the first cooling passage and the second cooling passage are positioned near a hot gas path surface of the platform.

6. The turbine nozzle of claim 1, wherein the first cooling passage and the second cooling passage are positioned near a leading edge of the platform.

7. The turbine nozzle of claim 1, wherein the first cooling passage and the second cooling passage are positioned on a suction side of the first nozzle vane and a pressure side of the second nozzle vane or between the first nozzle vane and the second nozzle vane.

8. The turbine nozzle of claim 1, wherein the first cooling passage is configured to direct the first flow of cooling fluid in the first direction toward the second nozzle vane, and wherein the second cooling passage is configured to direct the second flow of cooling fluid in the second direction toward the first nozzle vane.

9. The turbine nozzle of claim 1, wherein the first cooling passage is configured to direct the first flow of cooling fluid in the first direction toward a leading edge of the platform, and wherein the second cooling passage is configured to direct the second flow of cooling fluid in the second direction toward a trailing edge of the platform.

10. The turbine nozzle of claim 1, wherein the first cooling passage is configured to exhaust the first flow of cooling fluid along a hot gas path surface of the platform, and wherein the second cooling passage is configured to exhaust the second flow of cooling fluid along the hot gas path surface of the platform.

11. The turbine nozzle of claim 1, wherein the first cooling passage is configured to exhaust the first flow of cooling fluid along an edge of the platform, and wherein the second cooling passage is configured to exhaust the second flow of cooling fluid along a hot gas path surface of the platform.

12. The turbine nozzle of claim 1, wherein the platform is an inner platform, and wherein the first cooling passage and the second cooling passage are positioned near a radially outer surface of the inner platform.

13. The turbine nozzle of claim 1, wherein the platform is an outer platform, and wherein the first cooling passage and the second cooling passage are positioned near a radially inner surface of the outer platform.

14. A method for cooling a turbine nozzle of a gas turbine engine, the method comprising:

providing a turbine nozzle comprising a first nozzle vane, a second nozzle vane, and a platform connecting the first nozzle vane and the second nozzle vane, the platform comprising a first cooling passage and a separate second cooling passage defined therein such that the first cooling passage and the second cooling passage are not in fluid communication with one another;

wherein the first cooling passage is in fluid communication with a first cooling cavity defined within the first nozzle vane;

wherein the second cooling passage is in fluid communication with a second cooling cavity defined within the second nozzle vane;

wherein the first cooling passage and the second cooling passage at least partially overlap one another in an axial direction or a radial direction;

passing a first flow of cooling fluid through the first cooling passage in a first direction; and passing a second flow of cooling fluid through the second cooling passage in a second direction substantially opposite the first direction.

15. A gas turbine engine, comprising:

a compressor;

a combustor in communication with the compressor; and a turbine in communication with the combustor, the turbine comprising a plurality of turbine nozzles arranged in a circumferential array, each of the turbine nozzles comprising:

a first nozzle vane;

a second nozzle vane; and a platform connecting the first nozzle vane and the second nozzle vane, the platform comprising a first cooling passage and a separate second cooling passage defined therein such that the first cooling passage and the second cooling passage are not in fluid communication with one another;

wherein the first cooling passage is in fluid communication with a first cooling cavity defined within the first nozzle vane;

wherein the second cooling passage is in fluid communication with a second cooling cavity defined within the second nozzle vane;

wherein the first cooling passage and the second cooling passage at least partially overlap one another in an axial direction or a radial direction;

wherein the first cooling passage is configured to direct a first flow of cooling fluid in a first direction; and wherein the second cooling passage is configured to direct a second flow of cooling fluid in a second direction substantially opposite the first direction.

16. The gas turbine engine of claim 15, wherein the first cooling passage and the second cooling passage at least partially mesh with one another such that a portion of one of the first cooling passage and the second cooling passage is positioned between portions of the other of the first cooling passage and the second cooling passage in a circumferential direction.

17. The gas turbine engine of claim 15, wherein the first cooling passage and the second cooling passage at least partially overlap one another in the radial direction.

18. The gas turbine engine of claim 15, wherein the first cooling passage and the second cooling passage are at least partially intertwined with one another.

* * * * *